US008540546B2

(12) United States Patent
Lipman

(10) Patent No.: US 8,540,546 B2
(45) Date of Patent: Sep. 24, 2013

(54) TOYS

(75) Inventor: Steven Lipman, London (GB)

(73) Assignee: Muscae Limited, Ramsey (IM)

( * ) Notice: Subject to any disclaimer, the term of this patent is extended or adjusted under 35 U.S.C. 154(b) by 1643 days.

(21) Appl. No.: 11/912,666

(22) PCT Filed: Apr. 26, 2006

(86) PCT No.: PCT/GB2006/001530
§ 371 (c)(1),
(2), (4) Date: Oct. 25, 2007

(87) PCT Pub. No.: WO2006/114625
PCT Pub. Date: Nov. 2, 2006

(65) Prior Publication Data

US 2008/0160877 A1 Jul. 3, 2008

(30) Foreign Application Priority Data

Apr. 26, 2005 (GB) ..... 0508466.0
Mar. 2, 2006 (GB) ..... 0604215.4

(51) Int. Cl.
*A63H 30/00* (2006.01)

(52) U.S. Cl.
USPC ..... 446/175; 446/303

(58) Field of Classification Search
USPC ..... 446/175, 303
See application file for complete search history.

(56) References Cited

U.S. PATENT DOCUMENTS 4,857,030 A * 8/1989 Rose ..... 446/303
5,314,336 A * 5/1994 Diamond et al. ..... 434/169
5,636,994 A 6/1997 Tong
6,089,942 A * 7/2000 Chan ..... 446/175
6,255,800 B1 * 7/2001 Bork ..... 320/115

(Continued)

FOREIGN PATENT DOCUMENTS

EP 1 107 227 A2 6/2001
EP 1 776 990 A2 4/2007

(Continued)

OTHER PUBLICATIONS

Peter Rojas, The Garfield MP3 Player, Nov. 5, 2004, Engadget, p. 1
http://www.engadget.com/2004/11/05/the-garfield-mp3-player.*

(Continued)

*Primary Examiner* — Tramar Harper
(74) *Attorney, Agent, or Firm* — Blakely, Sokoloff, Taylor & Zafman LLP

(57) ABSTRACT

A toy is provided comprising: a transceiver (24, 28) for transmitting and receiving data over a wireless link; a processor (18, 32) a memory (34) for storing expressive responses; and an output (22, 38) for expressive responses; the toy being operable to receive trigger data relating to expressive responses, select an expressive response when trigger data is received, express the expressive response through the output; and to broadcast trigger data indicative that a response has been output. A method of communication between first (10) and second (12) toys is provided comprising: activating a first expressive response from the first toy (10) in the presence of the second toy (12); sending trigger data from the first toy (10) indicative of the first expressive response to the second toy (12); the second toy (12) selecting a second expressive response from memory (34) on receipt of said data, activating the second expressive response, and sending data indicative the second expressive response to the first toy (10).

58 Claims, 9 Drawing Sheets

(56) References Cited

U.S. PATENT DOCUMENTS

| | | | | |
|---|---|---|---|---|
| 6,319,010 | B1 | 11/2001 | Kikinis | |
| 6,356,867 | B1 * | 3/2002 | Gabai et al. | 704/270 |
| 6,368,177 | B1 | 4/2002 | Gabai et al. | |
| 6,544,098 | B1 | 4/2003 | Hampton et al. | |
| 6,663,393 | B1 * | 12/2003 | Ghaly | 434/262 |
| 2002/0000062 | A1 * | 1/2002 | Smirnov | 44/397 |
| 2002/0029388 | A1 | 3/2002 | Heisele | |
| 2003/0003839 | A1 * | 1/2003 | Lin | 446/175 |
| 2003/0130851 | A1 | 7/2003 | Nakakita et al. | |
| 2004/0082255 | A1 * | 4/2004 | Fong et al. | 446/75 |
| 2004/0198158 | A1 | 10/2004 | Driscoll et al. | |
| 2004/0259465 | A1 | 12/2004 | Wright et al. | |
| 2005/0009443 | A1 | 1/2005 | Martin et al. | |

FOREIGN PATENT DOCUMENTS

| | | | |
|---|---|---|---|
| GB | 2 423 943 | A | 9/2006 |
| JP | 11-207031 | A | 8/1999 |
| JP | 2001-179665 | A | 7/2001 |
| JP | 2005-001099 | A | 1/2005 |
| WO | WO 00/15316 | A2 | 3/2000 |
| WO | WO 00/15316 | A3 | 3/2000 |
| WO | WO 00/44460 | A3 | 8/2000 |
| WO | WO 0112285 | A1 * | 2/2001 |
| WO | WO 01/58552 | A1 | 8/2001 |
| WO | WO 02/02200 | A1 | 1/2002 |
| WO | WO 03/000370 | A1 | 1/2003 |
| WO | WO 2004/104736 | A2 | 12/2004 |

OTHER PUBLICATIONS

UK Intellectual Property Office, "Patents Act 1977: Search Report under Section 17" for Great Britain Patent Application No. GB0714148.4, mailing date of Search Report: Mar. 27, 2008 (5 pp.).

PCT International Search Report for PCT Counterpart Application No. PCT/GB2006/001530 containing Communication relating to the Results of the Partial International Search Report, 6 pgs., (Dec. 8, 2006).

PCT International Search Report and Written Opinion for PCT Application No. PCT/GB2008/002457 containing Communication relating to the Results of the Partial International Search Report, 19 pgs., (May 11, 2009).

* cited by examiner

TOYS

CROSS-REFERENCE TO OTHER APPLICATIONS

This is a National Phase of International Application No. PCT/GB2006/001530, filed on Apr. 26, 2006, which claims priority from Great Britain Patent Application No. 0508466.0 filed on Apr. 26, 2005 and Great Britain Patent Application No. 0604215.4 filed on Mar. 2, 2006.

BACKGROUND OF THE INVENTION

This invention relates to toys. In particular, although not exclusively, this invention relates to toys such as dolls that interact with each other.

Embedded computers and micro-processors have improved toys for children. They have been used most extensively in educational toys, but have also been used in interactive toys. ActiMates® Barney®, is one example of an interactive toy which responds to interaction from a child by appropriate vocalisations, and can sing-a-long to videos.

SUMMARY OF THE INVENTION

According to the present invention there is provided a toy comprising a processor; a memory for storing at least one group of data, each said at least one group consisting of a plurality of expressive responses, and each said group representing a respective theme; and an output for said expressive responses; the toy being adapted to exchange such responses with another such toy; and a port for connection to a computer to download said at least one group of data.

Preferably the toy comprises means for analysing said expressive responses to select a suitable one such response. The means for analysing said expressive responses to enable a suitable one such response to be selected preferably uses randomisation. The means for analysing said expressive responses to select a suitable one such response is preferably operable to receive and respond to situation data concerning its situation.

According to another aspect of the invention there is provided a toy comprising a processor, a memory for storing expressive responses, and an output for expressive responses, the toy being adapted to exchange such responses with another such toy, the toy further comprising a port for connection to a computer.

According to a further aspect of the invention there is provided a toy comprising: a transceiver for transmitting and receiving data over a wireless link; a processor; a memory for storing expressive responses; an output for expressive responses; and a port for connection to a computer, the toy being operable to receive trigger data relating to expressive responses, select an expressive response when trigger data is received, express the expressive response through the output; and to broadcast trigger data indicative that a response has been output.

According to a further aspect of this invention, there is provided a toy comprising: a transceiver for transmitting and receiving data over a wireless link; a processor; a memory for storing expressive responses; and an output for expressive responses; the toy being operable to receive trigger data relating to expressive responses, select an expressive response when trigger data is received, express the expressive response through the output; and to broadcast trigger data indicative that and/or of a response has been output.

Preferably at least some of the data is downloadable to the toy from said computer. The data preferably includes a set of such expressive responses and the expressive responses comprises a set of responses and counter-responses. The counter-responses are preferably compatible with the responses. These counter-responses are preferably adapted to be used by a further such toy in response to the responses of a further such toy.

Preferably the data is downloadable from a website via the internet.

An expressive response, as used herein, means output that communicates a message, such as emotion or language to a human onlooker.

This invention involves the realisation that interaction occurs between dolls, and other toys, when children play. By stimulating interaction between dolls, or other toys, this invention encourages such play.

The toy may store data, preferably trigger data, received in memory as an expressive response.

The expressive response may be a gesture. The expressive response may be a vocalisation. The expressive response may be a phrase, or music or sound.

The trigger data broadcast may indicate which expressive response was output. A toy may be operable to broadcast trigger data and/or make an expressive response on a user command. The user command may comprise moving or shaking the toy or squeezing the toy or pressing part of the toy.

Alternatively the toy may be operable to broadcast trigger data and/or make an expressive response when in proximity of a transmitter, such as an infra-red transmitter. The transmitter may be another toy, a docking station, a remote control, or an environment, such as a dolls house. The toy may transmit a signal at timed intervals. Such a signal could act as a proximity signal for another toy.

The trigger data may be indicative of the proximity of a second toy.

The processor may be operable to analyse the trigger data received for an indication of which expressive response it represents and select an appropriate expressive response. Expressive responses may be ranked and the response may be selected according to rank. The rank of the expressive response may be dependent on the trigger data. The expressive response may be selected using randomisation. Expressive responses may be chosen, preferably randomly chosen from group of responses all of which may have a particular rank.

Preferably output of an expressive response depends on some input from child.

Such input may comprise triggering a sensor in the toy.

The toy may comprise a code segment operable to download expressive responses, themes, or personality data from the internet.

Preferably expressive responses are grouped into a theme.

The toy may comprise a removable memory. Such a toy may be programmable.

The toy may comprise a physical connector. The toy may comprise an electromagnetic transceiver, preferably an infra-red, radio-frequency, or bluetooth transceiver.

Preferably the toy is a doll. It may be generic or a likeness of a sports star, celebrity, or pop star.

According to a further aspect of the invention there is provided a toy comprising: a transceiver for transmitting and receiving data over a wireless link; a processor; a memory for storing expressive responses; and an output for expressive responses; the toy being operable to receive trigger data relating to expressive responses, select an expressive response when trigger data is received, express the expressive response through the output; and to broadcast trigger data indicative that a response has been output, wherein the toy is further operable to receive and respond to situation data concerning its situation.

According to a further aspect of this invention, there is provided a dock for a toy comprising a physical connector for the toy for downloading data into the toy and which may be operable to connect to a network for downloading data from the network.

The connection to the network may be physical. The dock may comprise a recharging point for the toy.

According to a still further aspect of this invention there is provided a method of communication between first and second toys comprising: grouping expressive responses into at least one group; activating a first expressive response from one such group, the first toy in the presence of the second toy; sending trigger data from the first toy indicative of the first expressive response to the second toy; the second toy selecting a second expressive response from said one such group of expressive responses, from memory, on receipt of said trigger data, activating the second expressive response, and sending trigger data indicative of the second expressive response to the first toy.

According to a yet further aspect of this invention, there is provided a method of communication between first and second toys comprising: activating a first expressive response from the first toy in the presence of the second toy; sending trigger data from the first toy indicative of the first expressive response to the second toy; the second toy selecting a second expressive response from memory on receipt of said data, activating the second expressive response, and sending data indicative the second expressive response to the first toy.

The method may comprise downloading data (for example from the net, CD-Rom, memory card or remote) into a memory contained in the first or second dolls. The expressive response may be a gesture. The expressive response may be a vocalisation. The expressive response may be a phrase.

The trigger data broadcast may indicate which expressive response was output. The method may comprise broadcasting trigger data on a user command. The user command may comprise triggering a sensor in the toy, by, for example, shaking the toy or squeezing the toy or pressing part of the toy. The trigger data may be indicative of the proximity of a second toy.

The method may comprise analysing the trigger data received for an indication of which expressive response the data represents and selecting an appropriate expressive response. Expressive responses may be ranked and the response may be selected according to rank. The rank of the expressive response may be dependent on the trigger data. The expressive response may be selected using randomisation. Expressive responses may be chosen, preferably randomly chosen, from group of responses all of which may have a particular rank.

The output of an expressive response may depend on some input from child. The input may comprise triggering a sensor in the toy.

The method may comprise downloading expressive responses, themes, music, or personality data from the internet.

Expressive responses may be grouped into a theme.

According to a further aspect of this invention, there is provided a method of downloading data into a doll comprising logging onto a website; selecting a theme comprising a group of related data; and downloading the theme to the doll.

The theme may be expressed by triggers/responses by sound, expression, music or exclamations.

Any aspect of the invention outlined above may incorporate any of the preferred features described above, or below.

BRIEF DESCRIPTION OF THE DRAWINGS

Embodiments of this invention will now be described, by way of example only, with reference to the accompanying drawings, of which.

DETAILED DESCRIPTION OF THE INVENTION

Children enjoy playing with dolls, and often incorporate them into their imaginary play. Dolls such as those shown in FIG. 1, Milly 10 and Molly 12 are able to interact more fully with children, and with each other, in such play. Milly 10 and Molly 12 are dolls having generic bodies 14, 16 which may be themed by adding dresses, shoes and accessories.

Figure 1:
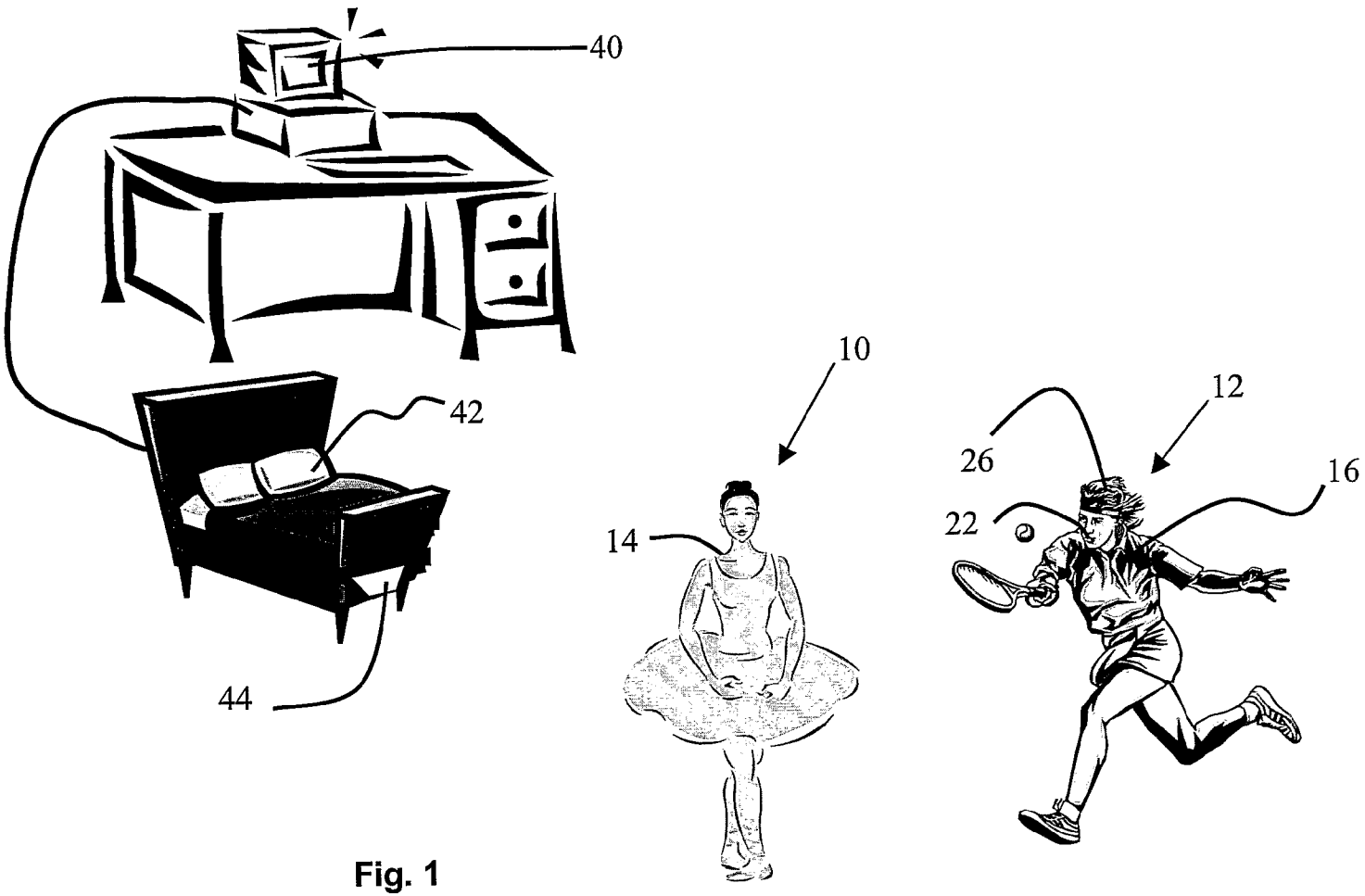
FIG. 1 shows schematically an illustration of two dolls and associated computer equipment.

As shown in FIG. 1, Milly 10 has a generic body 14 which represents a female adult and is themed as a ballerina, being dressed in a tutu with ballet shoes. Molly 12 also has a generic body 16 which represents a female adult, and is themed as a tennis player, having appropriate clothing and bat and ball accessories.

The theme may be pre-programmed, determined by the downloaded/inputted data, or set by a key accessory (tennis bat, ballet shoes, or a theme tag) which can be sensed by the doll through its communication system described below. The dolls' bodies may be manipulated into appropriate poses, as shown.

Figure 2:
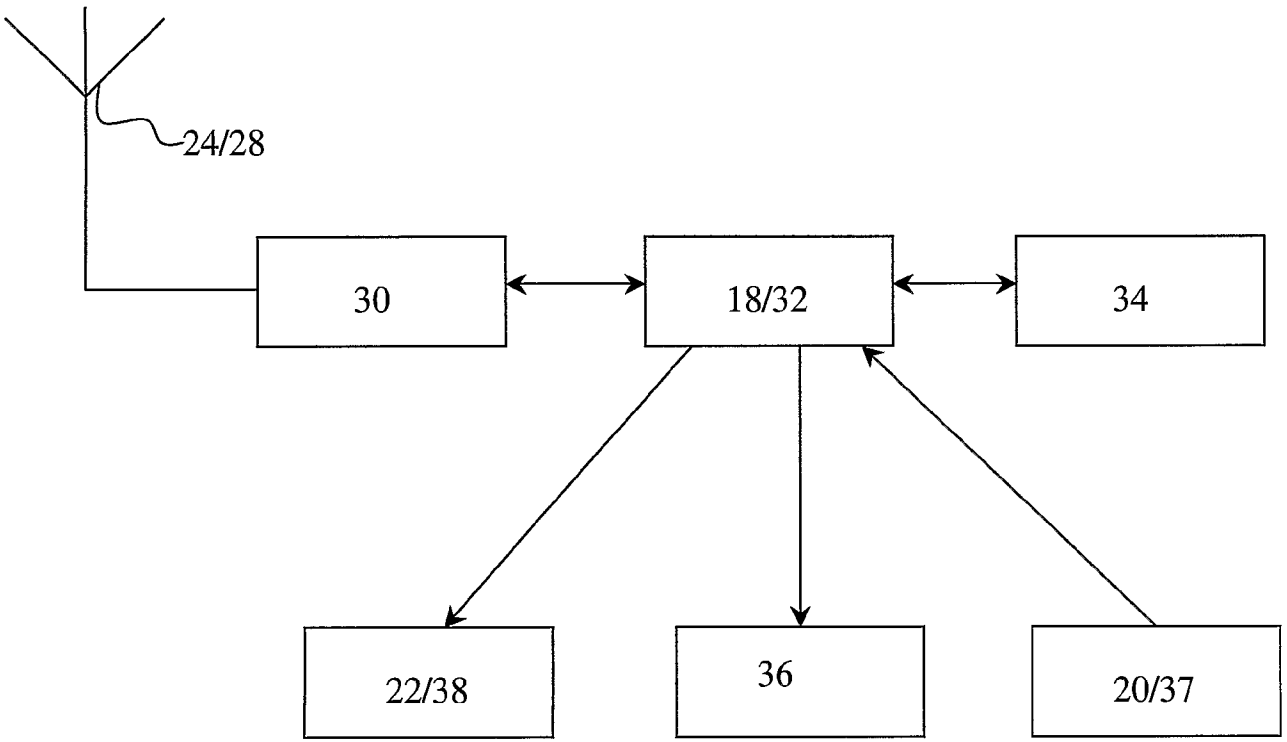
FIG. 2 shows schematically a block diagram of computer equipment inside a doll.

As shown in FIG. 2, each doll has an integrated computer 18 using this computer the dolls are able to interact according to their theme. For example, when Molly 12 is picked up an acceleration sensor 20 integrated into her body 16 provides a signal which acts as a trigger, causing her to say, for example, "Anyone for tennis?". Molly 12 has a loudspeaker 22 sited under the feature representing her mouth through which her synthesised voice can be heard.

This interaction is heard by the children playing with her. The statement is also transmitted via an infrared transceiver 24, conveniently located in her head 26, to any doll in line-of-sight, in this example Milly 10, who receives the transmission at her infrared transceiver 28. Infrared signals may reach the transceivers through the dolls' eyes and ears.

Once Milly's transceiver receives a signal from Molly's transceiver it is decoded by a decoder 30 and passed to a processor 32. The signal is tagged with data indicative of its theme (tennis) and of which of a number of classes of statement associated with the theme it is (in this example, invitation). Milly therefore "knows" that Molly has invited her to play tennis.

Milly then analyses the statements associated with her theme for a reply. These statements, which are stored in a memory 34 are also tagged both with data indicative of the doll's unique identification tag, of the manner in which the doll is currently themed and with data indicative of their class. The processor 32 has been pre-programmed to select a statement from an appropriate class. In this example, appropriate classes would be either "accepting an invitation" or "declining an invitation" on a random basis. The doll may also add a "comment". The processor may select, for example "Oh No!" (a rejection) followed by "I like ballet" (a comment) and cause that statement to be output through Milly's loudspeaker 36. At the same time, the processor may activate motors 38 which cause Milly to shake her head.

Also simultaneously, Milly broadcasts trigger data through her transceiver 28 indicative of what she has said. Molly can analyse the data in a similar manner to that set out above, and respond accordingly. For example, a rejection may cause her to make a sad noise or an angry noise, she may agree ("Yes, me too") or disagree with (That's horrid), or not respond to, the comment, and she may make another suggestion ("Shall we watch Wimbledon on TV?) or ask question ("What do you want to do?).

The conversation continues until one of the dolls does not make a response, or makes agreement or disagreement is reached.

If agreement is reached, so in the example above Milly selects "Yes, what fun", Milly may start interacting with her owner (or other doll or toy) saying, for example, "Can I put my tennis kit on now?".

Figure 3:
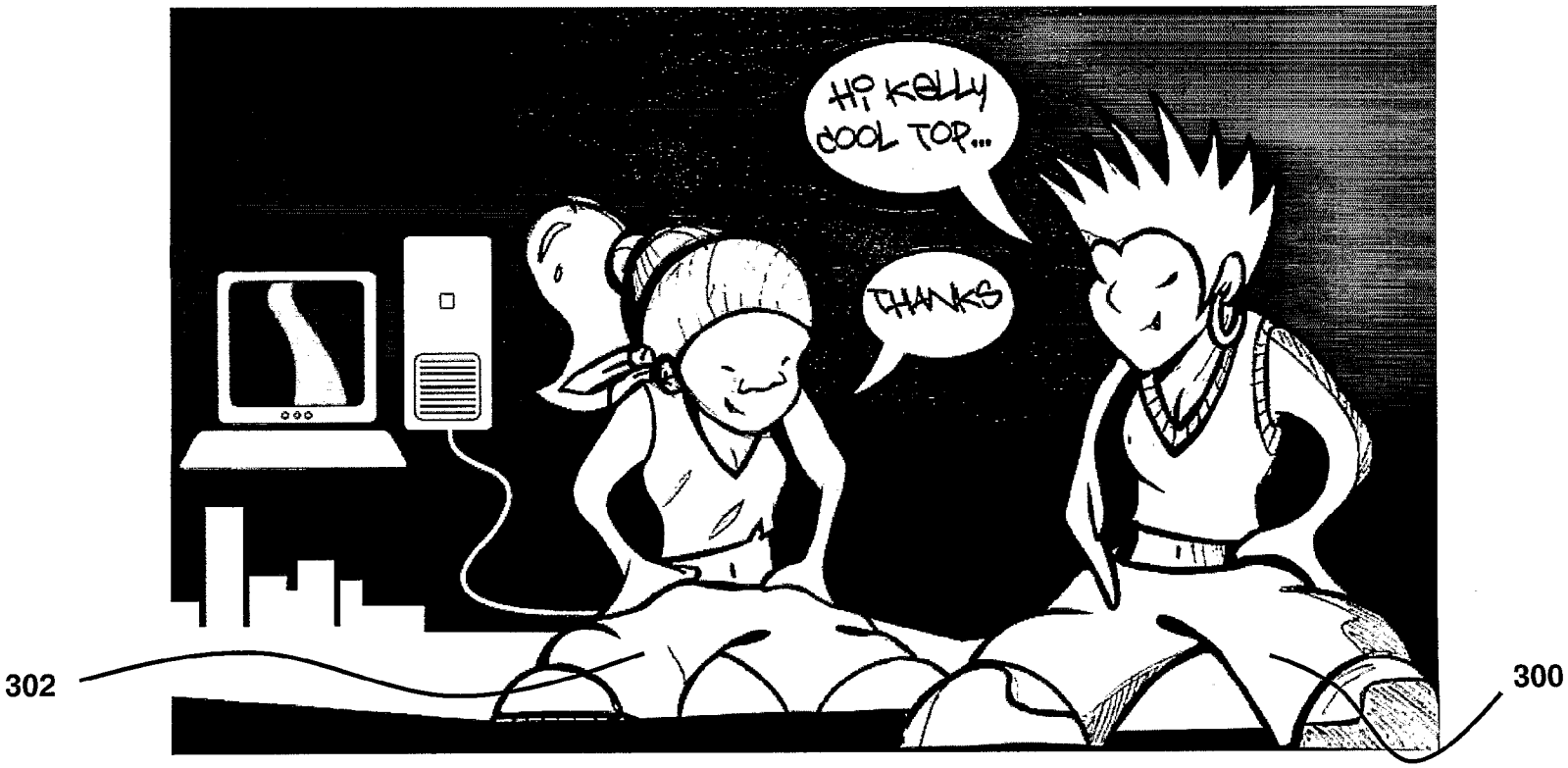
FIG. 3 shows schematically an illustration of two dolls interacting with each other, and one doll (the female) connected to a computer by cable to download data from the internet.

FIG. 3 illustrates an example of the interaction between two dolls. One doll, 300, asks the other doll, 302, a question; simultaneously trigger data, associated with the question is sent wirelessly. Doll 302 receives the trigger data and responds appropriately to the question.

The manner in which the dolls make their responses is preferably only partially random. The dolls may be pre-programmed to be friends (or enemies), which causes them to be more (or less) likely to accept each other's invitations, or generally respond positively to each other. Alternatively, the dolls may keep a record of how often their invitations are accepted or rejected by particular dolls, and reciprocate according to the value of this affective index.

The dolls may also keep a record of their own "mood", which may vary according to time of day and pre-programmable "personality" factors such as "outgoing" or "sporty". These factors may change as the theme of a doll is changed. The dolls may also keep a record of important dates, such as birthdays, anniversaries or public holidays. This mood value may also influence the response chosen. If one doll having a particular theme (for example sporty) interacts with another having the same theme, or a similar theme (adventure), they may be more likely to respond positively to each other. If the themes are not complementary (sleepy-time and adventure, for example) they may be more likely to respond negatively.

Each doll may have a serial port or similar connector through which she may be plugged in to a computer 40 either physically or through a wireless connection. Alternatively, each doll may have a docking station, for example a bed 42 that they can be connected to, and which may function both as a charging point for a rechargeable battery and as a data link and/or as a database for themes etc.

Figure 4:
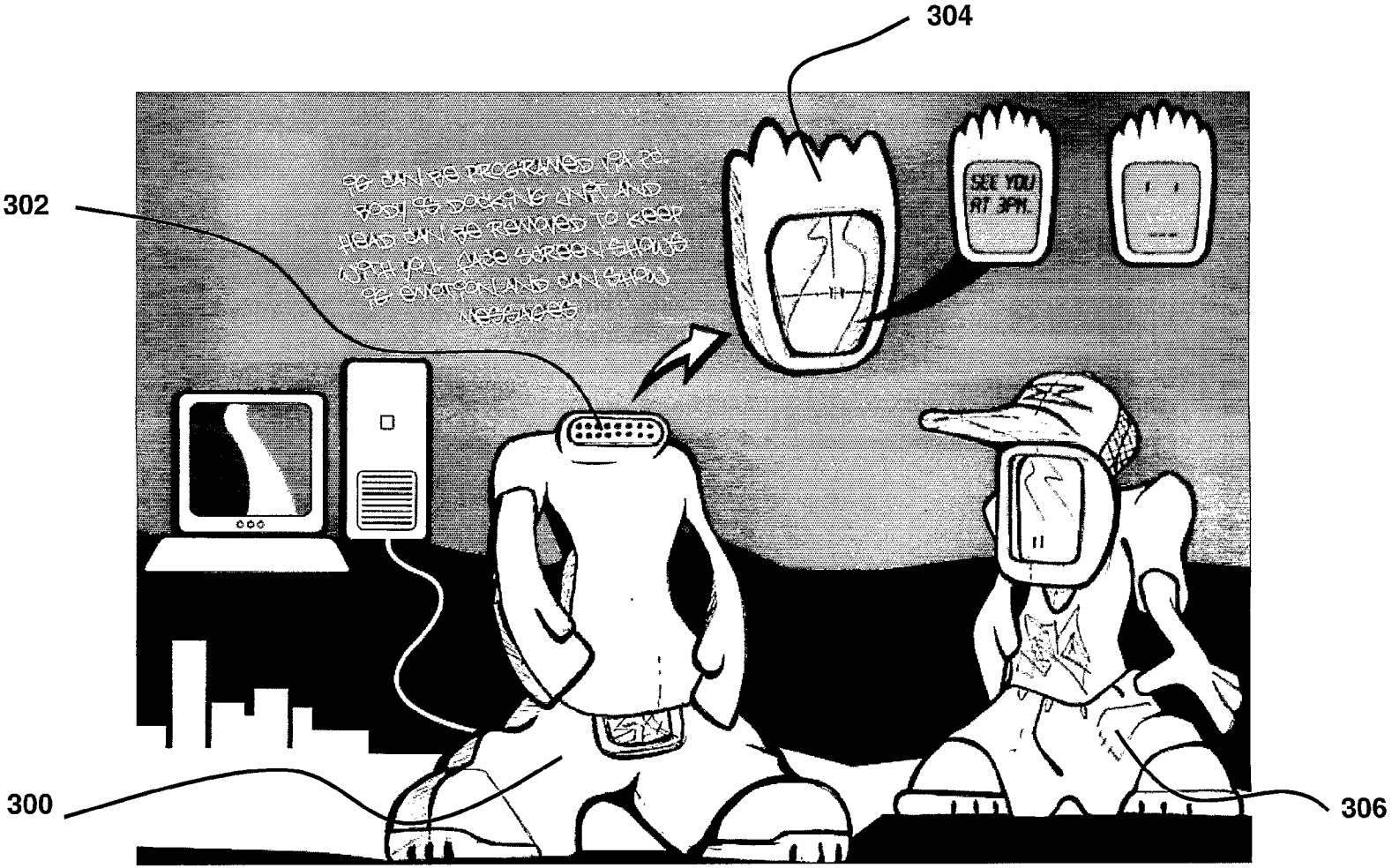
FIG. 4 shows schematically an illustration of a doll with a removable head/computer unit.

Alternatively, the docking station may be the doll's body with the head of the doll containing all of the features illustrated in FIG. 2. FIG. 4 shows schematically the connection port within the body of the doll and the head of the doll separated from the doll.

The dolls may thereby receive data which could be drawn from a CD-ROM or downloaded from the internet. Indeed, it is envisaged that a web community could be formed with an on-line shop for buying dolls', themes, music, accessories and reward tokens, a fashion boutique to give accessory tips, a design-your-own-doll section where doll features such as hair colour, skin colour, eye colour, body type and age could be chosen, and an order placed, a membership club, on-line games and competitions, etc.

Themes, in particular, could be purchased and downloaded from such a website. Such themes could be downloaded from a computer or docking station, or uploaded into the doll through a chip. The doll could itself access the internet, perhaps through a wireless connection.

Within the design-your-own-doll section a virtual doll may be designed. Clothes, accessories, speech, as well as doll features, can be chosen for the doll with a graphical representation of the doll shown during the process. The user may compare his/her virtual doll with those stored on the website, as well as with the designs of other users, creating an on-line community. The user may also, if required, order the requisite supplies to enable the user to create the virtual doll in real life. Previous purchases through the website will remain in the user profile, and purchases made from outside of the website (such as gifts, etc) may be entered into the user profile for future reference. If clothes, accessories, etc, already within the user profile are required for the virtual doll then only the required supplies, i.e. the supplies that the user does not already own, will be incorporated within the order.

Accessories, including clothes, could also be bought separately through the online shop. The accessories available would differ depending on the theme selected. For example, within the "Sporty" theme accessories such as tennis rackets and tracksuits would be listed, while in the "Urban" theme there could be hoodies and jeans etc.

FIG. 4 illustrates the process of ordering an accessory, as shown with the doll 400 being connected to the internet website via the docking station, the accessory, 402, arriving and the doll 404 interacting with the new accessory.

Reference was made previously to reward tokens. The reward token system allows parents to purchase tokens associated with his/her child's user account. These tokens could then either be given to the child as a gift, allowing the child to purchase any item within the online store, or could be used as part of a reward scheme. In the case of the reward scheme a parent could use the tokens as an incentive for the child to do his/her homework. For example: the parent buys 10 tokens, then tells his/her child that every time they do his/her homework on time they get a token. When the child has enough tokens they can use them on the website to purchase new dolls, accessories, etc.

The tokens would be in the form of codes that the parents would be given on purchase. The tokens would be associated with the child's account as the parent would log-in to his/her child's account using a parental access password. These codes could then either be printed or simply written down prior to giving them to the child.

Alternatively, or additionally, the tokens could be available for general purchase through the website, thereby allowing generic tokens to be purchased and posted, either directly to the child, as a gift for instance, or to the purchaser for use in a reward scheme. The tokens would be redeemed by the child logging into his/her account and entering the token code, crediting his/her account with the value of the token.

Such a website would be personalised both for the doll and for the user. A user could set up an account for herself, and sub-accounts for her dolls. Each doll has its personal data, for example, a birthday, a calendar, a diary, a friends list which is continually updated based on the dolls interactions, a mailbox accessible from its sub-account. Such a website allows a user many facilities for interaction with other users and other dolls. For example, a user could ask to organise a party for the dolls on Milly's friends list and mail them invitations. Such an invitation would be made known both to the invited dolls, for example Molly, who might accept or reject the invitation, according to her current affective index value for Milly, and her mood and their personality and their users, who could edit this acceptance or rejection. Once acceptance or rejection is sent Molly would remind her owner about the party at appropriate intervals.

Alternatively or additionally, the dock 42 may itself have ports 44 from which pre-loaded themes and situations (see below) can be downloaded.

The theme downloaded from the internet would be dictated by the users. For example, two friends might wish to download appropriate themes to their respective dolls prior to a play session. These themes would ideally be matched so that full interaction may be made between the dolls. For example, two dolls both with a "Sporty" theme would be able to interact to a fuller extent than two dolls, one of which having a "Gangsta" theme, the other having a "Ballerina" theme. Although generic interaction could occur between these two themes ("Gangsta" doll asks "Do you want to listen to some hip hop?", "Ballerina" replies "Oh No!, I'd much rather practice my plié!"), however, the conversation would end there.

The type of response given, and the set of responses, may also be influenced by the situation that one or more of the dolls are in. For example, when Milly's owner buys a dolls house different rooms in the dolls house have transmitters which emit an infrared signal which is coded to indicate different rooms. Alternatively or additionally, Milly's owner could buy tags and distribute them around her bedroom or the house in which she lives. Each situational tag, or product, such as a dolls house, stables etc. comes with an appropriate set of responses which can be downloaded into a doll's memory either through the dock 42 or over a wireless link.

The dolls may then select a subset of responses suitable for different situations as appropriate, or the probability of each response being selected may be enhanced or depressed. For example, in the garden, any positive responses in Milly's sports theme may be made more likely. If a theme has been registered for a doll, and the doll moves into an appropriate situation, she may ask her owner to start the theme by dressing her appropriately. For example, Milly's current theme is that of a ballerina, but one theme registered and so available for her is gardening. When taken into the garden she may ask "Can I get changed for gardening?" and if access to the theme depends on a key theme tag "Where is my spade?".

Accessories, such as animals or cars, may also have such computer equipment integrated into them. So, for example, Milly's horse can whinney affectionately when she gets on it, her car may tell her to fasten her seat belt and, depending on her mood, and it's acceleration sensor say "Lets go racing" or "Slow down please".

Dolls can also communicate their mood to each other and through their loudspeaker, on user command, when making a particularly expressive response, or on receiving appropriate trigger data (for example "How are you today?").

The user also can use a remote control to communicate with the dolls, and to give them commands, and to program them. The user can construct themes through the website, and more advanced users can construct schemes of responses and download them to the dolls through software. The remote could also contain downloaded data allowing the user to up date the doll remotely and separately from his/her computer. This could be stored on a memory stick or memory card that is placed in the remote.

The user constructed themes may be stored within the user's profile such that the doll may be easily returned to a previous user defined theme, effectively providing the dolls with multiple personalities. However, only one "personality" at a time may be downloaded to a doll.

The themes created via the website would also enable the user to specifically select speech for the doll from a list associated with particular generic themes; the list of phrases could number 1,000 or more per theme. Each generic theme, "Gangsta", "Sports", "Urban", etc (see FIG. 3), would have a list of associated phrases to choose from. The memory within the doll would be capable of holding a large number of phrases; however the number of phrases stored in the doll would be dependent on the length of conversation required. The length of conversation required could in turn be dependent on the user's age as defined within the user profile; a "speech architect" would determine the length of conversation. Conversations would therefore range from a couple of minutes to tens of minutes in length. The younger a user is, the shorter his/her attention span, and therefore less phrases would be required per theme. However, at least one question and one answer phrase would be downloaded to the doll. A random set of phrases may be selected by the website to allow the users to quickly and easily select and download phrases to the doll with little user input other than selecting the theme.

So that users do not become disinterested in the dolls the list of phrases available through the website would be updated periodically, thus allowing the dolls to keep up-to-date with the latest trends. The types of phrases would remain the same, i.e. questions, statements and answers, such that a doll with the latest phrases could still interact adequately with a doll with a previous set of phrases.

Figure 5:
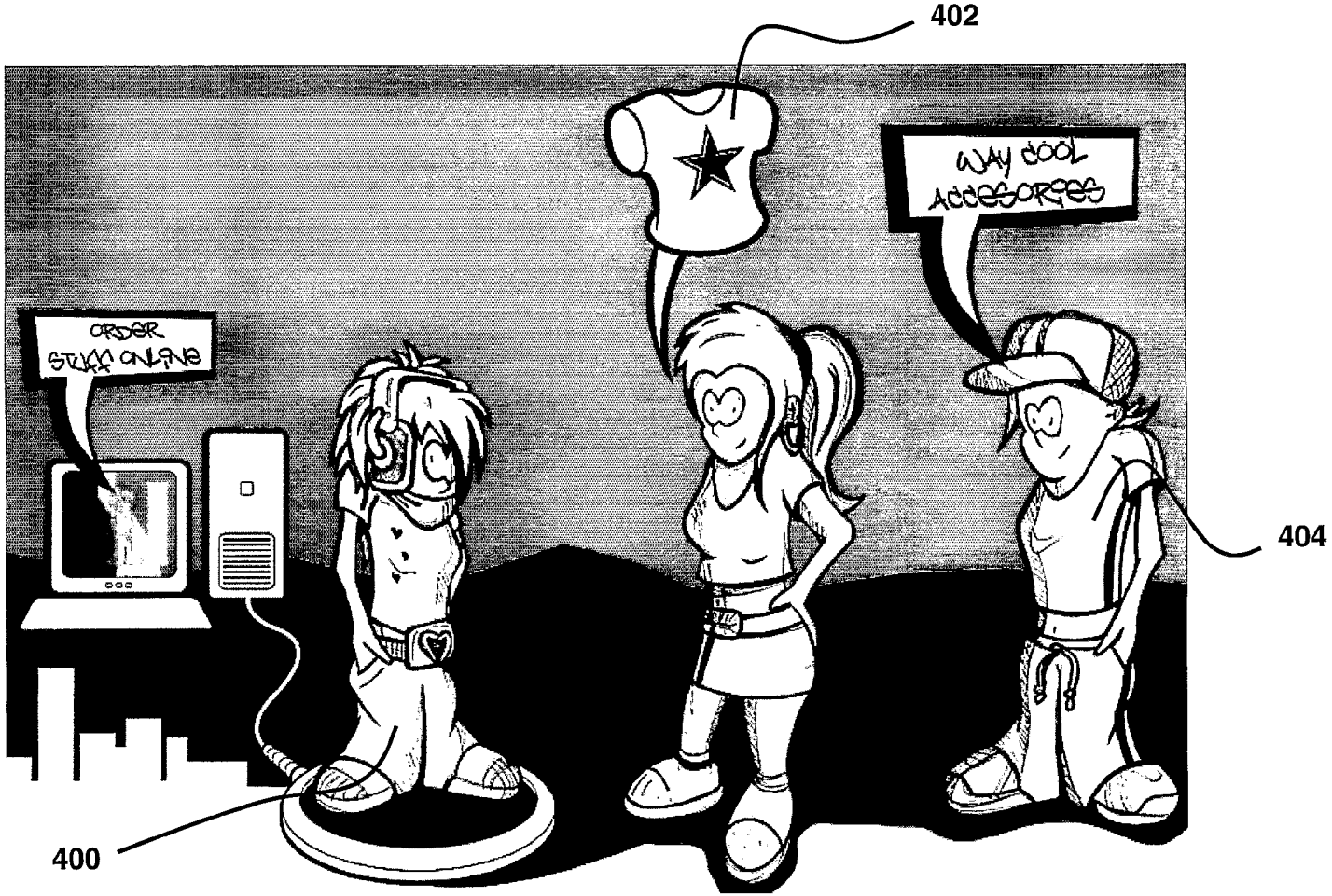
FIG. 5 shows schematically an illustration of the ability to purchase accessories from a website on the internet, the associated interaction between the dolls and a male figure on a docking station receiving data from the internet via a computer.
Figure 6:
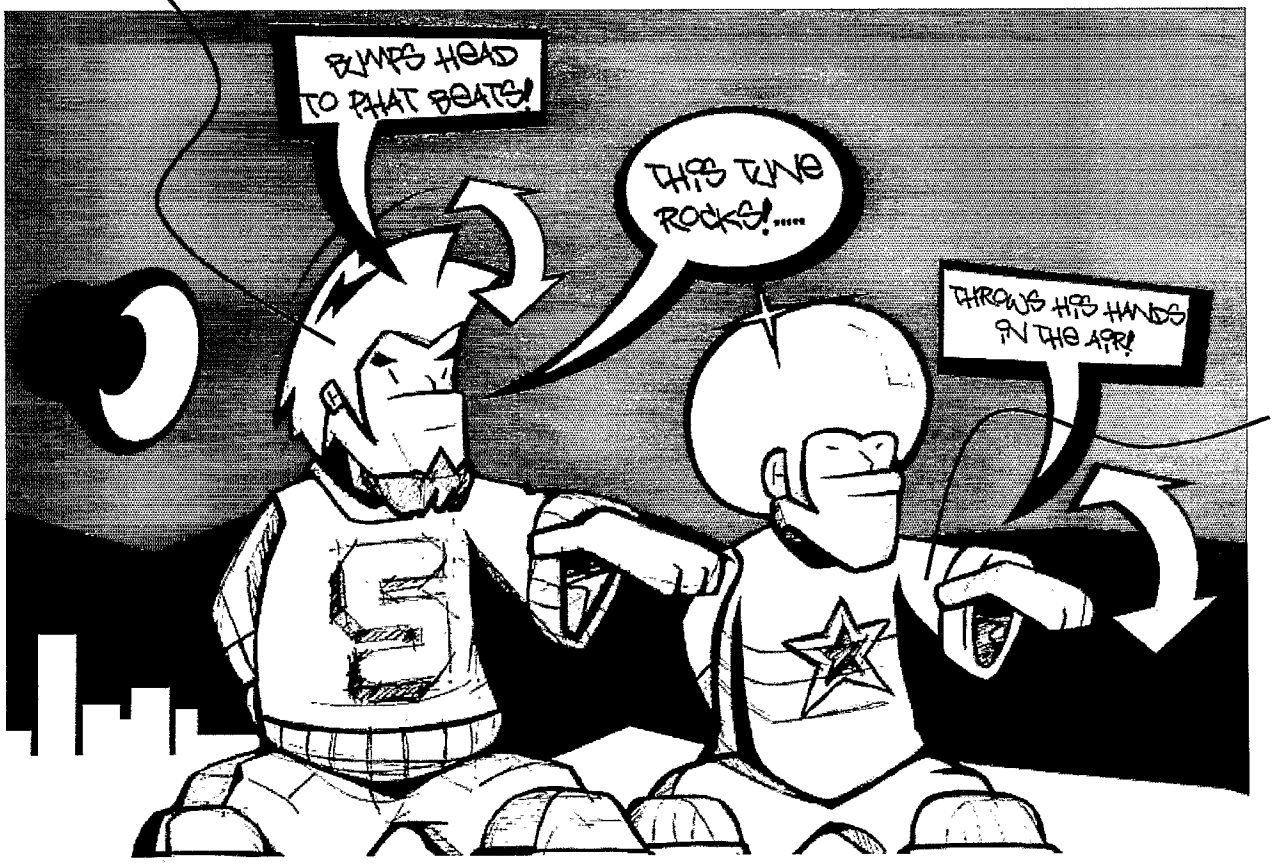
FIG. 6 shows schematically two dolls interacting with music being played.

In addition to downloadable themes and speech the user may also download music appropriate to the doll's theme. The downloaded music may have associated data tags that allow the dolls to interact with the music (see FIG. 5). This interaction may range from the dolls nodding their heads, 500, or moving their hands, 502, to, if the doll's theme does not correspond to the music, speech, for example "Oh dear!, What's this noise?". The response of the dolls could allow the music to be changed to a more acceptable track or to have the volume increased or decreased depending on the response.

The doll, through the use of personal headphones, may also be used as a standalone personal music player. In this instance a switch would be used on the doll to initiate a music only mode.

Dolls can also exchange information about their personalities. When two dolls meet for the first time they may be "introduced" by their owners as a form of play; and will simultaneously register basic personality information with each other, and create an affective index for the other doll.

An important aspect of the functionality of the dolls is their interaction with their owner. There are two aspects to this, firstly the control of the owner over the doll, and secondly the effect of the owner's actions on the doll.

In relation to the first aspect, the dolls owner can force them to respond in a certain way to a question by manipulating them so that they nod or shake their heads. This motion is picked up by a sensor, and forces' a negative or positive response. It may well be thought appropriate to provide a master control, for use by the owner's parents, to mute the doll or switch it off. It is also possible to change a doll's parameters, such as her personality, her affective index in relation to the doll's she knows and her mood through the docking station. It is possible to reset a doll's parameters to their original values or to those of the previous day.

The level of control that the owner has can be pre-set in software as appropriate for the age and level of experience of the user. Similarly, various of the doll's functions can be turned off in software, or set to an age-appropriate level.

The aesthetics and vocabulary of the dolls can also be tailored so that it is age appropriate for a target audience. Various themes may have an age appropriate rating. This allows hip hop themed dolls, for example, for a teenage market.

In relation to the second aspect, the dolls may track the time of day; and may request to be fed, or to be put to bed at an appropriate time. Whether the user performs the appropriate action (using the dock) will have an appropriate effect on the doll's mood. The doll can sense through its acceleration sensor, whether it is being played with, or indeed, abused, and react accordingly. The treatment of a doll may interact with its personality. For example, a doll with an outgoing personality may have its mood depressed if not provided with opportunity for interaction with its owner or other dolls.

An example of the type of hardware that can be used in the applications described above is shown in FIG. 2. An infrared transceiver provides a wireless data link for a doll. Infrared is the low-cost and low-range option, but the transceiver could, alternatively or additionally, be a radio transceiver, using a protocol such as "Bluetooth". The microprocessor may be any suitable type, for example a 576 MHz 64 bit CPU. Memory is a flash memory card for personality data, which may be used for temporary data such as themes or supplemented by a removable memory stick for individual themes.

A simple scheme of expressive responses for two themes is set out below:

Tennis

| Expressive Response | Category |
|---|---|
| Lets Play Tennis! | Starter - Active |
| Anyone for Tennis? | Starter - Active |
| I love tennis. | Starter - Passive |
| Do you like tennis? | Starter - Question |
| Great Idea! | Answer - positive |
| Yes please! | Answer - positive |
| I dunno . . . | Answer - neutral |
| Not right now . . . | Answer - negative |
| Its my serve | Statement - active |
| Its your serve | Statement - active |
| 15-love (etc) | Statement - functional (positive-negative) |
| love-15 (etc) | Statement - functional (negative-positive) |
| 15 all (etc) | Statement - functional (neutral) |
| Oh No! | Statement - passive - negative |
| Great Shot! | Statement - passive - positive |
| Unlucky . . . | Statement - passive - positive |
| Wow! Ace Play! | Statement - passive - positive |
| Lets have tea . . . | Ending - active - positive |
| Whew! I'm tired now! | Ending - passive - negative |

Each expressive response in this theme has three data tags attached: one a sequencing tag in respect of the sequencing of the type of phrase to be used (starter, statement, question, answer, ending) which, represents where it comes in the interaction; one an action tag (active, passive, functional) which indicates whether a course of action is proposed and provides an indication of the type of reply required, or whether a reply is required; and one an affective tag (positive-negative) which gives an idea of the affective quality of the remark.

Different schemes may be put together using these tags, and a number of simple rules. For example, a doll will begin with a starter, make statements for three minutes or so (the time may be varied with the likely concentration span of the owner, which may be judged according to the owner's age), or a certain number of statements, and then make an ending. Certain categories of response (for example questions) trigger certain categories of next response (for example answers), and the affective quality of the response may influence the further response. For a further example, only two starters may be allowed in a conversation, and a passive starter must follow an active starter. In general, statements can be made at any point in the conversation, and added to an answer. After a statement a further statement or a question may follow. An ending may finish the conversation. A large number of different conversations could occur between dolls programmed with even this, extremely simple, scheme. Functional statements relate to the rules of the game, and rules of response are programmed accordingly.

Another example of a theme follows.

Tea Party

| Expressive Response | Category |
|---|---|
| Hello | Starter - passive |
| Welcome to my tea party | Starter - active |
| Would you like some tea? | Starter - question |
| I love tea and cakes | Starter - passive |
| How are you? | Question* |
| Do you like tea? | Question |
| Do you like coffee? | Question |
| I like tea at teatime | Statement - passive |
| I love chocolate cake! | Statement - passive |
| We made carrot cake last Thursday | Statement - passive |
| I'll be mother | Statement - active |
| Yes - scrummy | Answer |
| Not really | Answer |
| I'm allergic to that | Answer |
| That was lovely, but I have to go now | Ending - active |
| Goodbye | Ending - passive |

Any expressive responses that meet the requirements of the tag may be chosen randomly, or according to affective quality. Occasional nonsense conversations are possible, and give a humorous quality to the interaction. *The How are you question is a specific type of response which constrains the doll to answer according to the value of their affective index for which answers are built in, and do not usually alter according to the theme.

It will be noted from the above examples that starters are merely particular forms of statements or questions, whilst endings are merely a special form of statement. Also, excluding starters or endings (since they may in certain circumstances be statements), it is only statements that have an action tag.

Possible forms of conversation are now described in more detail. In general, three forms of conversational structure are envisaged. In all cases the conversation is initiated, 700, by the user activating the doll using the above described method. Firstly; the "speech architect" preordains the entire conversation and as a consequence a limited number of conversations will be available, FIG. 7*a* shows a flow diagram of a conversation progression using this form of conversational structure. In this scenario the box 702 (Random path selector) randomly selects the conversation, 704. The content of the conversation 704 is dependent on the theme of the dolls. When conversation 704 ends the box 706 (Another conversation?) decides whether another conversation is selected. If no further conversation is selected then via box 708 (End) one doll triggers the other doll (by means of an appropriate sequencing tag) that the conversation has ended. In this scenario all dolls due to interact would be required to download the same theme and conversation set. A conversation set would include multiple conversations allowing the dolls to be used many times without requiring new conversations to be downloaded every time the doll is used. To provide variation the speech architect may provide multiple conversation sets for every theme, thus allowing a new conversation set to be downloaded when the current one is exhausted. These conversation sets may be updated over time, thus allowing the dolls longevity to be increased by keeping them up to date with current trends. This type of conversation would allow the "speech architect" to create a conversation of an exact length in time, therefore the conversation can be easily tailored to the age of the user.

Figure 7B:
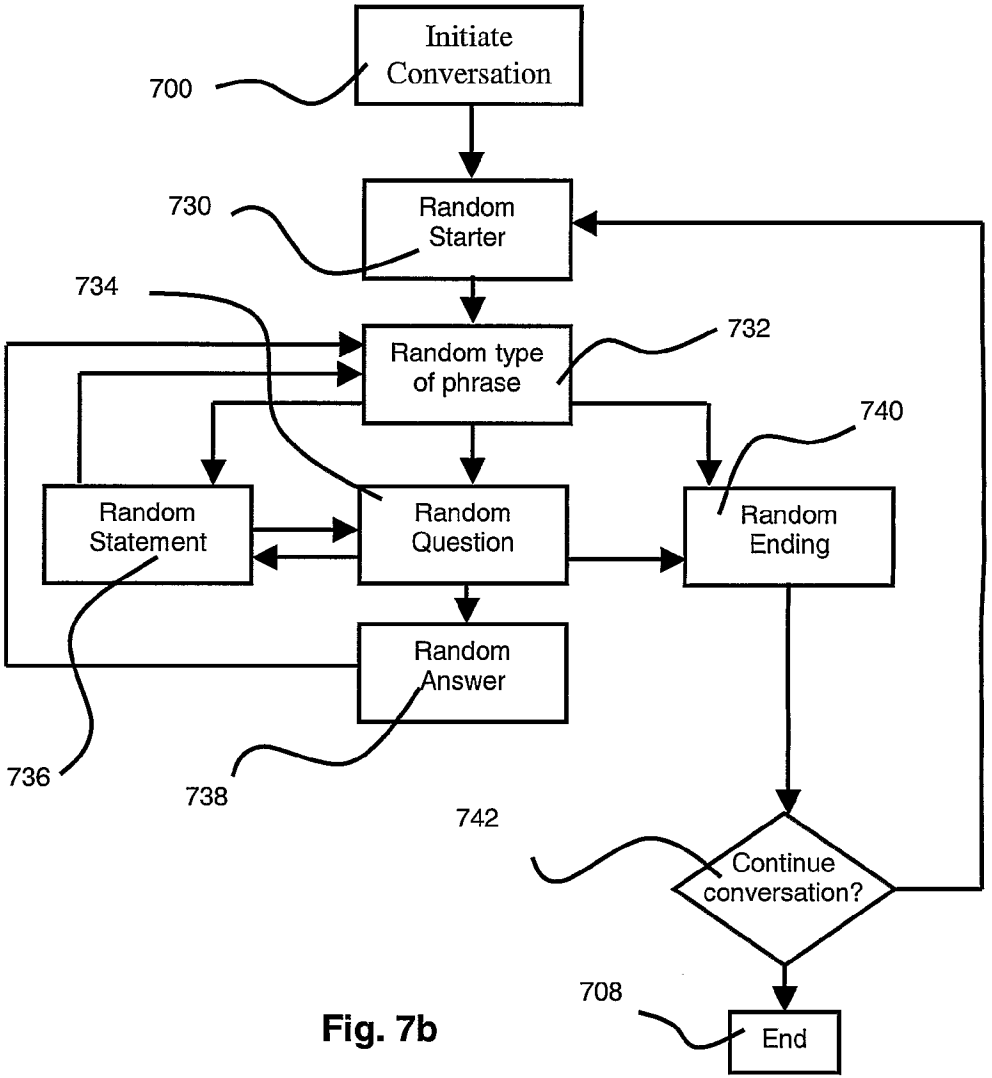
FIG. 7 show three possible forms of conversational structure, in the form of flow diagrams.
Figure 7A:
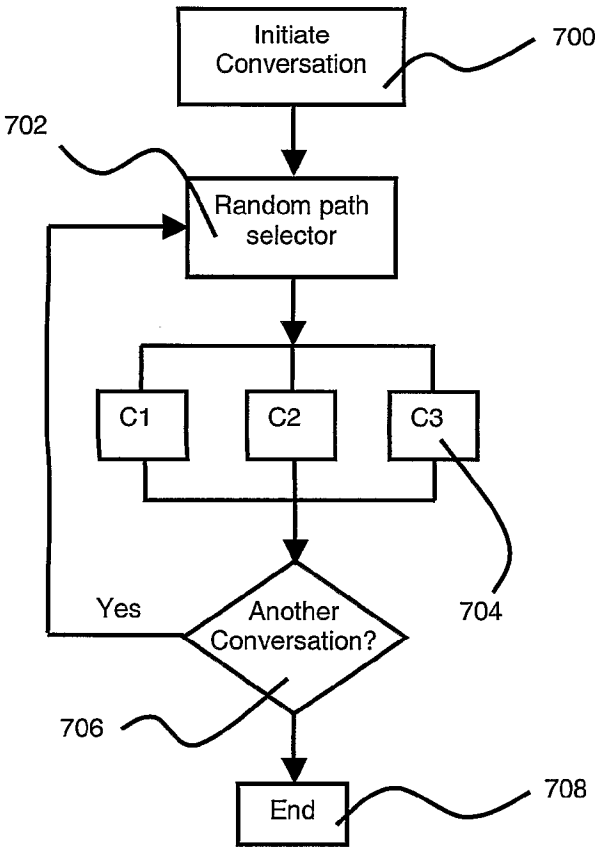
Figure 7C:
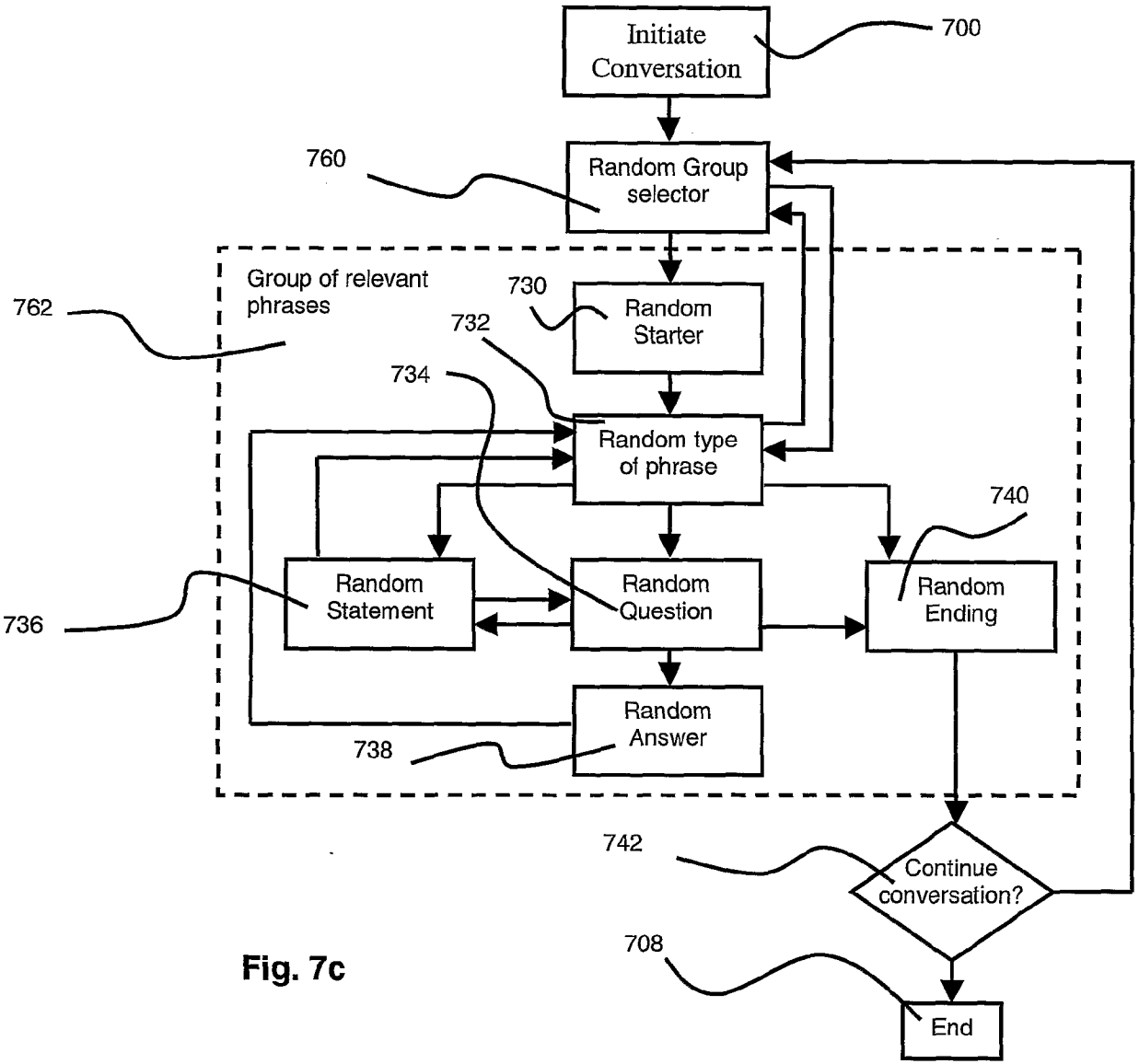

In FIGS. 7*b* and 7*c* (now described) like reference numerals refer to like parts.

Secondly, the "speech architect" simply creates phrases and associates them with the type of speech (see table below) and a theme. FIG. 7*b* shows a flow diagram of a conversation using this form of conversational structure. The phrases are selected entirely randomly, using boxes 730 (Random starter) and 732 (Random type of phrase), purely based on the type of phrase; the selection process is based on the previously described rules. The box 732 may choose any of the further boxes 734 (Question), 736 (Statement), 738 (Answer) or 740 (Ending). If an ending phrase, 740, is chosen then box 742 (Continue conversation?) decides on whether another starter phrase should be selected. This decision will partly be based on the current length of the conversation. If it is decided not to continue the conversation the box 708 (End) will trigger the dolls to end the conversation. The user may download any of the phrases associated with a theme to build up a database of phrases stored on his/her doll. For example, a starter phrase will always begin the conversation, 730, followed by a randomly chosen type of phrase 732, but not another starter phrase. If the phrase chosen were a question phrase then an answer phrase would follow. However, the answer chosen would be random and therefore may not correspond to the question. To avoid too many nonsense conversations the questions and answers created by the "speech architect" would be as generic as possible. This form of conversational structure would obviously provide the greatest number of possible conversations for any given number of phrases.

| Type of phrase | Expressive quality | Meaning of phrase type |
|---|---|---|
| Starter | Passive/Active Positive/Neutral/ Negative | A starter phrase initiates a conversation and may be any of the other types of phrases except an ending. |
| Statement | Passive/Active/ Functional/ Positive/Neutral/ Negative | A statement phrase is point of fact. |
| Question | | A question phrase is a question requiring an answer. |
| Answer | Positive/Neutral/ Negative | An answer phrase answers the question and always follows a question. |
| Ending | Passive/Active Positive/Neutral/ Negative | An ending phrase will end the conversation and is an answer or statement. This also may be followed by another starter phrase. |

Thirdly, and in the preferred embodiment; the "speech architect" structures the phrases within a particular group of phrases 762, this particular group typically being a specific theme, such as "Sports". Each group of phrases would be self-consistent, so that for example it would contain answers consistent with the various questions, and so on. Each group is then associated with a set of data tags as described previously, thus facilitating an appropriate response to be randomly selected from within the group of phrases. FIG. 7*c* shows a flow diagram of this form of conversational structure. Within the group of relevant phrases box 730 selects a random starter. An appropriate type of phrase is then selected by box 732 (Random type of phrase), then depending on the type of phrase selected an appropriate question (734), statement (736), answer (738) or ending (740) is chosen. This continues until an ending is selected, at which point box 742 (Continue conversation?) decides whether the conversation should continue. If not then box 708 (End) triggers the dolls that the conversation has ended. This would provide a greater number of possible conversations than the first form of conversational structure. It would also provide the most natural conversations that would be different every time due to the random selection of phrases. Again the rules prescribed previously would be used to determine the type of phrase selected.

In the preferred embodiment, boxes 760 (Random Group selector) and 742 (Continue conversation) are optional. A more complex variant of the preferred embodiment is now described also with reference to FIG. 7*c* in which the function of these boxes is described. The doll may be capable of randomly selecting the particular group of relevant phrases 762 (see the box 760). These may be sub-groups within the overall theme group; additionally or alterntatively, theme groups may be arranged into larger super-groups. For example a theme group may be "Tennis", with a super-group being "Sports" and a sub-group "Wimbledon". The group "Tennis" would contain all phrases relevant to tennis in general with the sub-group "Wimbledon" containing all information relating to the Wimbledon tennis tournament. This would allow for more detailed conversations within a theme as the phrases contained within the groups or super-groups could be used to link different sub-groups, as terms within the group or super-group would appear in more than one sub-group.

Figure 8:
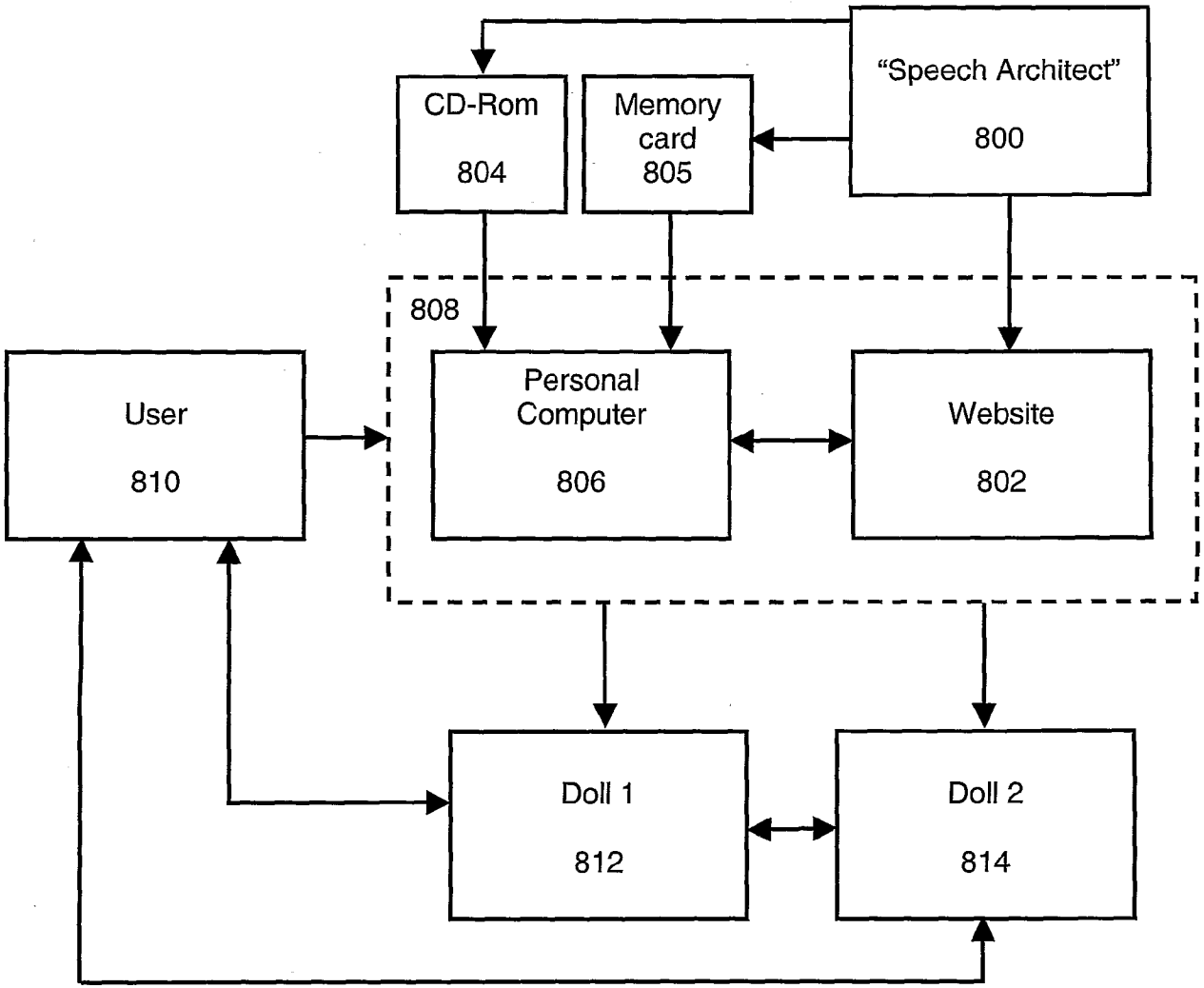
FIG. 8 shows schematically the flow of data from the various parties.

With reference to FIG. 8 the flow of data between the various parties will now be described. As discussed previously the "speech architect" 800 determines the phrases and their associated theme, group and tags. The "speech architect" then uploads the phrases either to the website, 802, to a CD-Rom 804, or to a memory card 805, or to any/all of these storage facilities. These phrases may then be downloaded to the users' doll(s), 812/814, using his/her personal computer, 806, via the interface 808. The user 810 may also input phrases directly to his/her personal computer 806, or to the website 802. These phrases may then be saved for future use and/or downloaded to the doll(s), 812/814.

The user 810 may also interact directly with the doll(s), 812/814, via physical interaction, for example using buttons on the doll to initiate conversation, or via a remote control. In this way the user may prompt the doll(s) to initiate any of the above-described actions, for example a conversation or music playing. The doll(s), 812/814, may also prompt the user to perform an action; as discussed previously the doll(s) may ask to be fed or to play a certain game.

Such toys and dolls provide children with different opportunities for interaction, and enhance their play.

It is of course to be understood that the invention is not intended to be restricted to the details of the above embodiments which are described by way of example only.

It will be understood that the present invention has been described purely by way of example, and modifications of detail can be made within the scope of the invention.

Each feature disclosed in the description, and (where appropriate) the claims and drawings may be provided independently or in any appropriate combination.

What is claimed:

1. A toy comprising:

a processor;

a memory for storing at least one group of data, each group consisting of a plurality of expressive responses, and each said group representing a respective theme;

an output for said expressive responses; and at least one of means for connection to a computer and a connector for connecting to a computer, to download each said group of data, the group of data for download being user-selectable to enable user selection of a particular theme;

the toy being configured to exchange such responses with another such toy, each said group of data comprising both responses and counter-responses, so that the toy may converse with another such toy on the particular theme;

wherein a new such group of data can be loaded into said memory so that the toy can converse on a different user-selectable theme;

whereby the toy can converse in a plurality of different user-selectable themes, one theme at a time.

2. A toy according to claim 1 further comprising means for analyzing said expressive responses to select a suitable one such response.

3. A toy according to claim 2 wherein said means for analyzing said expressive responses to select a suitable one such response is operable to receive and respond to situation data concerning its situation.

4. A toy according to claim 2 wherein the means for analysing uses randomization.

5. A toy according to claim 1 in which expressive responses are ranked and the response is selected according to rank.

6. A toy according to claim 5 wherein the rank is dependent on trigger data relating to expressive responses.

7. A toy according to claim 1 in which expressive responses are chosen from a group of responses all of which have a particular rank, and/or said expressive responses are chosen randomly from said group of responses.

8. A toy according to claim 1 in which output of an expressive response depends on some input from the user.

9. A toy according to claim 8 wherein the input is triggering a sensor in the toy.

10. A toy according to claim 1 further comprising: a transceiver for transmitting and receiving data over a wireless link; means for receiving trigger data relating to said expressive responses, for selecting one such expressive response when trigger data is received, for expressing the said expressive response through the output, and for broadcasting via the transceiver trigger data indicative that a response has been output.

11. A toy according to claim 10 in which the trigger data indicates which expressive response was output, or the proximity of a second toy.

12. A toy according to claim 1 wherein at least some of said data is downloadable to the toy from said computer, or from a website via the internet, or from a CD-ROM.

13. A toy according to claim 1 wherein said counter-responses are compatible with said responses.

14. A toy according to claim 1, wherein said data comprises speech data.

15. A toy according to claim 14 wherein the speech data includes at least one of: a sequencing tag, an action tag, and an affective tag.

16. A toy according to claim 1, wherein said data comprises music data.

17. A toy according to claim 1, wherein said data relates to accessories.

18. A toy according to claim 17 wherein the accessories include at least one of: clothes, buildings, equipment, and transportation.

19. A toy according to claim 1, wherein said output includes a transducer, the transducer being at least one of: a loudspeaker; and a motor operable to move at least one feature of said toy.

20. A toy according to claim 1 wherein the toy is further operable to receive and respond to situation data concerning its situation.

21. A toy according to claim 20 wherein the situation is at least one of: the toy's environment, the time of day, and the date.

22. A toy according to any claim 1 in which the expressive response is at least one of: a gesture, a vocalization, a phrase, and music.

23. A toy according to claim 1 operable to broadcast trigger data on a user command, said user command comprising shaking the toy or squeezing the toy or pressing part of the toy.

24. A toy according to claim 1 comprising a code segment operable to download expressive responses, grouped data, personality data from the internet, or music from the internet.

25. A toy according to claim 24 comprising means for reproducing the music audibly, preferably said music being audibly reproduced using personal headphones.

26. A toy according claim 24, wherein said downloaded music is in a digitally compressed format.

27. A toy according to claim 1 comprising a removable memory, said removable memory preferably containing a group of data representing a theme.

28. A toy according to claim 1 comprising a physical connector.

29. A toy according to claim 1 comprising an electromagnetic transceiver.

30. A toy according to claim 1, wherein said toy is programmable.

31. A toy according to claim 1 in combination with a further toy according to claim 1, each toy being configured to exchange expressive responses with the other.

32. A toy according to claim 1, wherein the processor is configured to analyze said expressive responses to select a suitable one such response, using randomization.

33. A system comprising a toy comprising a processor;

a memory for storing at least one group of data, each group consisting of a plurality of expressive responses, and each said group representing a respective theme;

an output for said expressive responses; and at least one of means for connection to a computer and a connector for connecting to a computer, to download each said group of data, the group of data for download being user-selectable to enable user selection of a particular theme;

the toy being configured to exchange such responses with another such toy, each said group of data comprising both responses and counter-responses, so that the toy may converse with another such toy on the particular theme;

wherein a new such group of data can be loaded into said memory so that the toy can converse on a different user-selectable theme;

whereby the toy can converse in a plurality of different user-selectable themes, one theme at a time; and a dock for said toy, said dock comprising a physical connector for the said toy for downloading data into the said toy and which is operable to connect to a network for downloading data from the network.

34. A system according to claim 33 comprising a recharging point for the toy.

35. A method of communication between first and second toys comprising:

grouping a plurality of expressive responses into at least one group of data, said at least one group representing a particular theme, each toy being configured to exchange such responses with the other toy, each said group of data comprising both responses and counter-responses, so that the toys may converse on the particular theme;

selecting, loading and storing a new such group of data into a memory so that the toys can converse on a different theme, the group of data being user-selectable to enable user selection of a particular theme;

activating a first expressive response from said at least one group stored in said memory of the first toy, the first toy being in the presence of the second toy;

sending trigger data from the first toy indicative of the first expressive response to the second toy;

the second toy selecting a second expressive response from said at least one group of expressive responses, from said second toy's memory, on receipt of said trigger data, activating the second expressive response, and sending trigger data indicative of the second expressive response to the first toy;

whereby the toys can converse in a plurality of different user-selectable themes, one theme at a time.

36. A method according to claim 35 including analyzing said expressive responses to select a suitable one such response.

37. A method according to claim 36 wherein the analyzing uses at least one of randomization and situation data concerning its situation.

38. A method according to claim 35 in which the expressive response is at least one of: a gesture, a vocalization, a phrase, and music.

39. A method according to claim 35 in which the trigger data broadcast indicates which expressive response was output.

40. A method according to claim 39 wherein the trigger data is broadcast on a user command, said user command comprising triggering a sensor in the toy by at least one of: shaking the toy; squeezing the toy; and pressing part of the toy.

41. A method according to claim 35 in which the trigger data is indicative of the proximity of a second toy.

42. A method according to claim 35 comprising analyzing the trigger data received for an indication of which expressive response the data represents and selecting an appropriate expressive response.

43. A method according to claim 35 in which expressive responses are ranked and the response is selected according to rank.

44. A method according to claim 43 wherein the rank of the expressive response is dependent on the trigger data.

45. A method according to claim 35 in which the output of an expressive response depends on some input from a user.

46. A method according to claim 35 comprising downloading expressive responses, themes, personality data from the internet, or music from the internet.

47. A method of downloading data into a toy, to enable the toy to exchange expressive responses with another such toy, the method comprising:

grouping a plurality of expressive responses into at least one group of data, said at least one group representing a particular theme, each toy being configured to exchange such responses with the other toy, each said group of data comprising both responses and counter-responses, so that the toys may converse on the particular theme;

selecting, loading and storing downloading a new such group of data into a memory so that the toys can converse on a different theme, the group of data being user-selectable to enable user selection of a particular theme, wherein downloading comprises logging onto a website; selecting a group of related data representing a respective theme; and downloading the user selected theme to the toy, said data enabling the toy to converse with another such toy in a plurality of different user-selectable themes, one theme at a time, and wherein the toy comprises at least one of means for connection to a computer and a connector for connecting to a computer to download said user selectable theme.

48. A method according to claim 47, of purchasing accessories relevant to a theme, comprising logging onto the website; selecting a theme; and purchasing accessories relevant to said theme.

49. A method according to claim 48 wherein said related data includes at least one of: music; and speech.

50. A method according to claim 47, of allowing tokens to be purchased on a website, wherein said tokens can be redeemed for items associated with said toys available for sale within said website.

51. A method according to claim 50, wherein a user requires a plurality of tokens to purchase a single item thereby providing an incentive to obtain more tokens.

52. A non-transitory computer readable memory for a toy, the toy comprising a processor; the memory; an output means, and at least one of means for connection to a computer and a connector for connecting to a computer; wherein the non-transitory computer readable memory enables the toy to:

store at least one group of data, each group consisting of a plurality of expressive responses, and each said group representing a respective theme;

to output said expressive responses via the output means; and download, using the at least one of means for connection to a computer and a connector for connecting to a computer each said group of data, the group of data for download being user-selectable to enable user selection of a particular theme;

exchange such responses with another such toy, each said group of data comprising both responses and counter-responses, so that the toy may converse with another such toy on the particular theme; and enable a new such group of data to be loaded into said memory so that the toy can converse on a different user-selectable theme;

whereby the toy can converse in a plurality of different user-selectable themes, one theme at a time.

53. A non-transitory computer readable memory according to claim 52 wherein said counter-responses are compatible with said responses.

54. A non-transitory computer readable memory according to claim 53 wherein said counter-responses are configured to be used by the another such toy in response to the responses of the said toy.

55. A non-transitory computer readable memory according to claim 52 wherein said set of such expressive responses is a set of speech responses.

56. A non-transitory computer readable memory according to claim 55 wherein the set of speech responses is organized into a plurality of groups.

57. A non-transitory computer readable memory according to claim 52, including means for enabling the purchase of an item corresponding to a given theme.

58. A non-transitory computer readable memory according to claim 52 wherein the user uses a website to download the user selectable theme.

* * * * *